US007552919B2

(12) United States Patent
Lisena

(10) Patent No.: US 7,552,919 B2
(45) Date of Patent: Jun. 30, 2009

(54) MATERIAL TRANSFER VACUUM DEVICE

(75) Inventor: Mario Lisena, Glen Cove, NY (US)

(73) Assignee: Halm Industries Co., Inc., Glen Head, NY (US)

( * ) Notice: Subject to any disclaimer, the term of this patent is extended or adjusted under 35 U.S.C. 154(b) by 332 days.

(21) Appl. No.: 11/465,909

(22) Filed: Aug. 21, 2006

(65) Prior Publication Data

US 2007/0056452 A1 Mar. 15, 2007

Related U.S. Application Data

(60) Provisional application No. 60/711,729, filed on Aug. 26, 2005.

(51) Int. Cl.
*B65H 3/08* (2006.01)

(52) U.S. Cl. ..... 271/90; 271/94; 271/107; 271/112; 271/132

(58) Field of Classification Search ..... 271/90, 271/94, 99, 100, 107, 112, 132
See application file for complete search history.

(56) References Cited

U.S. PATENT DOCUMENTS 3,172,321 A 3/1965 Schrader
3,618,935 A 11/1971 Howatt
3,709,077 A 1/1973 Trogan et al.
4,666,145 A 5/1987 Blumle
5,415,068 A * 5/1995 Marzullo ..... 53/492
5,417,158 A 5/1995 Parsio
5,441,248 A 8/1995 Kristola
5,865,433 A 2/1999 Morrissette
5,944,304 A * 8/1999 Branecky et al. ..... 271/2
6,488,194 B1 12/2002 Couturier
RE38,033 E 3/2003 Okonski et al.
6,773,006 B2 * 8/2004 Andreyka et al. ..... 271/96

FOREIGN PATENT DOCUMENTS

DE 3644035 A1 6/1988
DE 4405541 C1 3/1995

* cited by examiner

*Primary Examiner*—David H Bollinger
(74) *Attorney, Agent, or Firm*—Hoffmann & Baron, LLP

(57) ABSTRACT

A feeder head assembly is provided for transporting a material in a printing apparatus. The feeder head assembly includes a housing and a cap. The housing is at least partially rotatable about a longitudinal axis. Also, the housing includes an inner hollow chamber and an opening into the chamber. The inner hollow chamber is adapted to be in fluid communication with a vacuum source for decreasing pressure within the chamber. The opening is defined by a rim. The cap is removeably secured to at least a portion of the rim. The cap includes at least one aperture passing therethrough, wherein the at least one aperture is in fluid communication with the vacuum source.

26 Claims, 10 Drawing Sheets

MATERIAL TRANSFER VACUUM DEVICE

The present application claims priority to provisional patent Application Ser. No. 60,711,729, filed Aug. 26, 2005. This earlier filed provisional application is incorporated herein by reference.

BACKGROUND OF THE INVENTION

The present invention relates to a device for transporting a printable material within a printing machine, and more particularly a device for transporting a printable material using vacuum.

Vacuum assisted material handling assemblies are often used for manipulating sheets of print material, such as paper, envelopes, labels, etc. In particular, vacuum assisted rollers are desirable in high-speed printing applications, where it is important that one sheet be picked-up and transported at a time. Contemporary vacuum assisted feeder heads use a rotatably mounted cylindrical body having surface apertures. The apertures are coupled to a vacuum source and are used to create a negative surface pressure for picking up and moving the print material. The ability of the feeder head to properly engage and retain pieces of print material is correlated to surface texture of the feeder head engagement surfaces, as well as the size and configuration of the apertures, the vacuum source and feeder head itself.

Variations in print material and general maintenance often demand changes in the surface texture or aperture configuration on the feeder head. For example, the material engagement surface of the feeder head may be worn down or a larger or different aperture is needed. However, in order to change or repair the surface texture or aperture configuration on the feeder head, traditionally the entire cylindrical feeder head body needs to be removed and replaced. Such repairs and/or changes are difficult and often involve the neighboring assembly in the printing apparatus. Some more recent feeder heads include an outer sleeve or plate that has its own apertures that align with the apertures on the more traditional feeder head. However, the outer sleeve/plate aperture profile is limited by the size and configuration of the underlying cylinder apertures. Thus, more extensive surface or aperture profile changes once require the replacement of the entire feeder head.

Thus, it is desirable to provide a device for transporting a printable material which overcomes the shortcomings found in the art of material transfer assemblies as set forth above while also providing improved structural and operating features.

SUMMARY OF THE INVENTION

The present invention provides a feeder head assembly for transporting a material in a printing apparatus. The feeder head assembly includes a housing and a cap. The housing is at least partially rotatable about a longitudinal axis. Also, the housing includes an inner hollow chamber and an opening into the chamber. The inner hollow chamber is adapted to be in fluid communication with a vacuum source for decreasing pressure within the chamber. The opening is defined by a rim. The cap is removeably secured to at least a portion of the rim. The cap includes at least one aperture passing therethrough, wherein the at least one aperture is in fluid communication with the vacuum source.

Additionally, alternative aspects of the present invention can include an opening rim having at least a portion extending longitudinally across a portion of the housing. Also, the hollow chamber can include portions of disposed on opposed sides of the longitudinal axis. Further, the at least one aperture can include a plurality of apertures aligned in at least one row. Further still, the opening can have different dimensions and/or a different configuration from that of the at least one aperture. Yet further, the assembly can further include a shaft supporting the housing and adapted to rotate the housing between a first an second position.

Additionally, further alternative aspects of the present invention can include the cap having a perimeter and at least a portion thereof disposed on at least a portion of the rim. Also, an inner portion or inner hollow region of the cap can define at least a portion of the inner hollow chamber; or the cap can include a trough which forms an extension of the inner hollow chamber. Further, the cap can be removed from the feeder head in a radial direction from the longitudinal axis. Further still, at least a portion of the cap can define at least a portion of an axial end of the feeder head assembly. Yet further still, the cap can include at least one projection extending from the cap into the opening toward the chamber.

The present invention further provides a feeder head assembly including a cap and a housing at least partially rotatable about a longitudinal axis. The housing includes an inner hollow chamber and an outer opening into the chamber. The inner hollow chamber is adapted to be in fluid communication with a vacuum source for decreasing pressure within the chamber. The opening extends longitudinally across a substantial portion of the housing. The cap is removeably secured to the housing and covers at least a portion of the opening. The cap includes at least one aperture passing therethrough, wherein the at least one aperture is in fluid communication with the vacuum source.

The present invention further provides an assembly for transporting a material in a printing apparatus. The assembly includes a printing unit, a shaft, a feeder head and a vacuum source. The shaft is at least partially rotatable about a longitudinal axis. The feeder head is supported by the shaft for conveying the material toward the printing unit. The feeder head includes an outer housing and a cap. The housing and the cap defining a hollow chamber. The housing including an outer opening in the housing extending into the hollow chamber. At least a portion of the opening extends longitudinally across a portion of the housing. Also, the cap is removeably secured to the housing and includes at least one aperture passing therethrough. Further, the at least one aperture is disposed over the opening. The vacuum source decreases pressure within the hollow chamber. Also, the vacuum source is in fluid communication with the chamber and the at least one aperture.

Additionally, further alternative aspects of the present invention can include the cap being adapted to be removed from the housing without removing the feeder head from the shaft. Also, the cap can be adapted to be removed from the housing while the feeder head remains secured within the printing apparatus. Further, the assembly can include a drive mechanism coupled to the shaft, wherein the drive mechanism is adapted to move the feeder head between a first position and a second position.

It is therefore desirable to provide a device for transporting a printable material that is easy to maintain and/or alter to suit numerous printing jobs. In particular, one aspect of the present invention provides a feeder head assembly that is easily reconfigured and does not require the removal of the entire feeder head from the printing apparatus. Another aspect of the present invention provides a feeder head cap whose apertures are not limited by an aperture configuration on the underlying main feeder head housing. Yet another aspect of the present invention provides a feeder head cap that can easily replaced with a cap of a different design to adjust the vacuum profile and/or engagement of print material on the feeder head assembly.

DETAILED DESCRIPTION OF THE PREFERRED EMBODIMENTS

Figure 1:
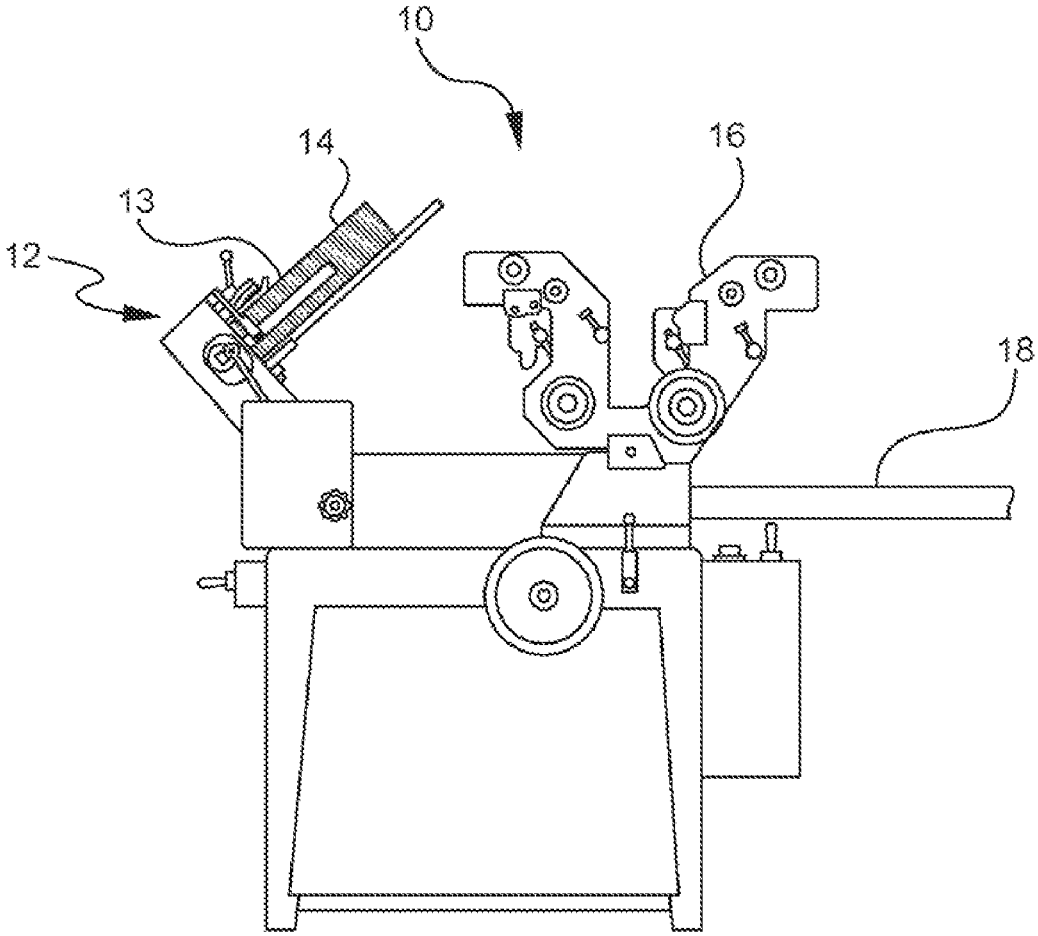
FIG. 1 is a side elevational view of a printing press with a material feeder.

The present invention includes a material transfer device that uses vacuum to hold a piece of material and transport it between a first and second position. In the preferred embodiment, the transfer device may be used in a printing press for transporting pieces of printable material, such as envelopes or sheets of paper. Such a printing press is manufactured by Halm Industries Co., Inc. of Glen Head, N.Y. under the trademark JET PRESS®. It is also within the contemplation of the present invention that the transfer device may be used in other types of machines in which sheets of material are moved such as mail sorters or copying machines.

With reference to FIGS, 1-3, a printing press 10 of a type well known in the art typically includes a feeder 12 having a portion 13 which can hold a stack of pieces of printable material 14. This material may be in the form of envelopes, sheets of paper or other material such as plastic, or other printable material. The feeder transports the printable material from the stack into a printing station 16 of the machine wherein an image is transferred to the printable material. Once printed, the material is transferred to an output table 18 where it can be stacked and await removal from the machine by an operator. The present invention relates to the material transfer device 20 which preferably forms part of the feeder 12. The material transfer device or feeder head assembly 20 is disposed below the material holding portion 13 of the feeder such that it is positioned at the bottom of the stack of printable material 14. The feeder head assembly 20 preferably uses a vacuum source to engage and grip the piece of printable material 14 on the bottom in the stack. The feeder head assembly 20 then rotates from a first position to a second position thereby moving the material from the stack onward toward the printing station 16. In the preferred embodiment, the feeder head assembly 20 rotates less than a full 360 degrees and reciprocates back and forth between the first and second position in order to move a piece of printable material. In an alternative embodiment, the transfer device 10 could continuously rotate in order to transport the printable material. The mechanism may be reciprocated by a drive mechanism of the type disclosed in U.S. Pat. No. 5,417,158, the disclosure of which is incorporated by reference herein in its entirety.

Figure 2:
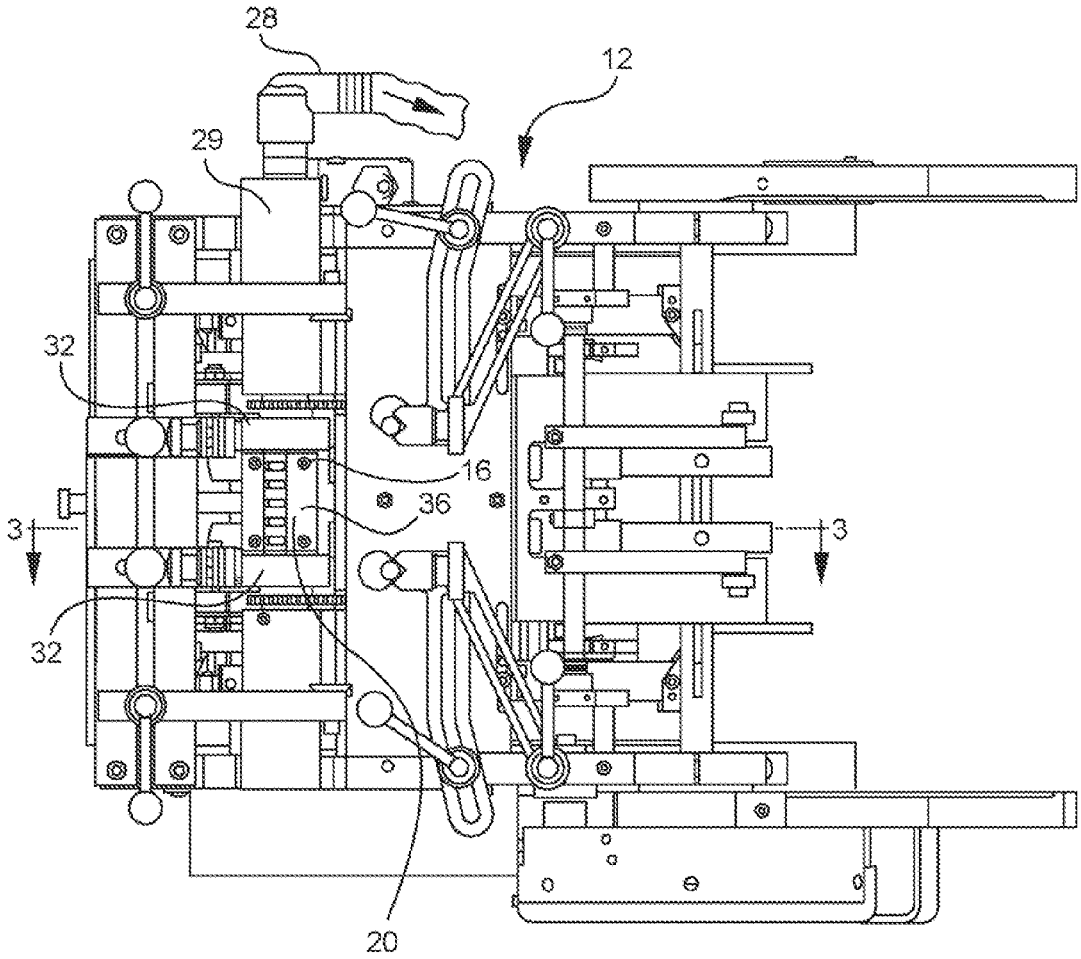
FIG. 2 is a top plan view of the material transport device of the present invention in the feeder of a printing press.
Figure 3:
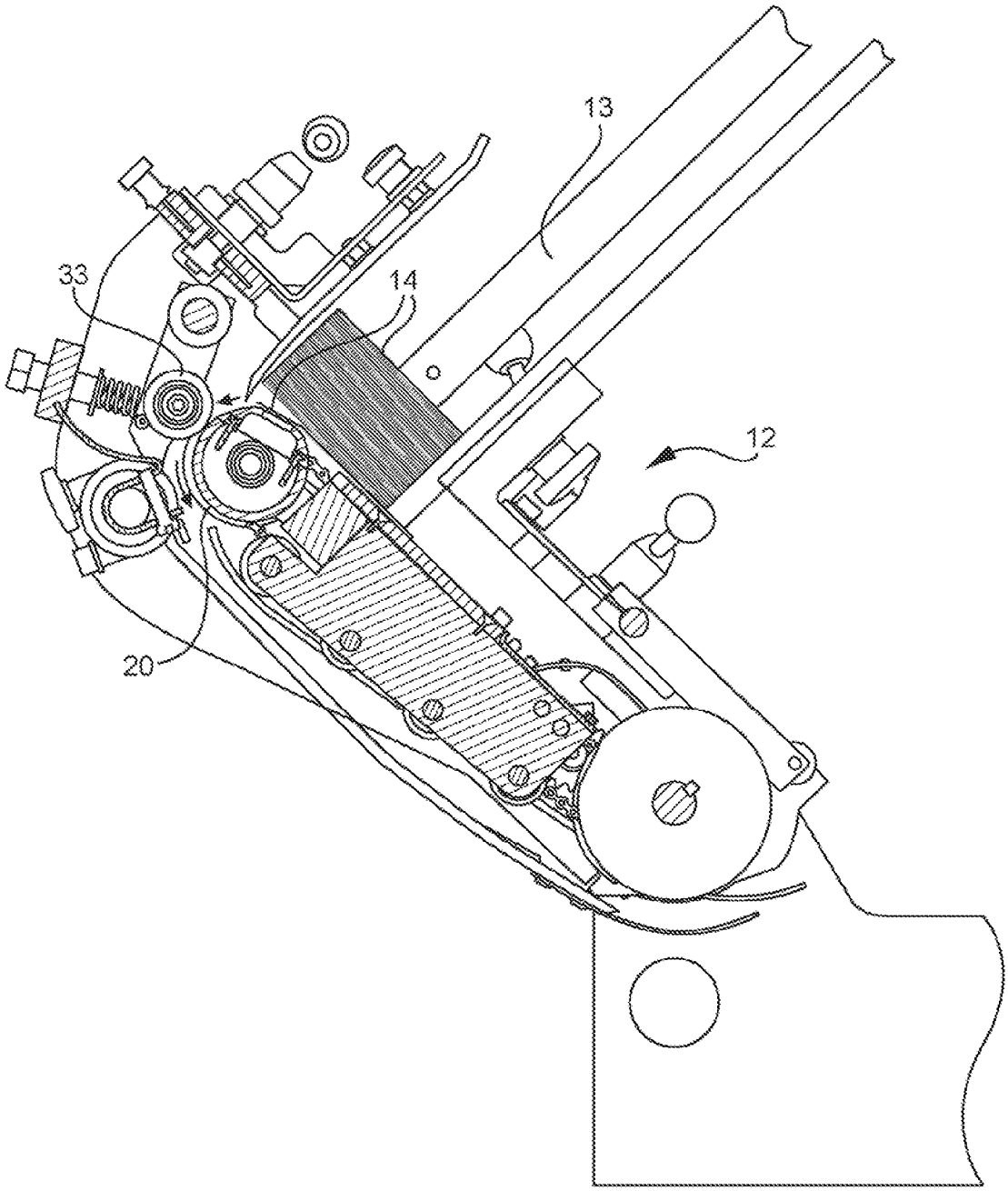
FIG. 3 is a cross-sectional view of the material feeder taken along line 3-3 of FIG. 2.

With reference to FIGS. 2, and 4-6, the feeder head assembly 20 of the present invention preferably includes a generally cylindrical feeder head 22 in the form of a hollow drum. The feeder head 22 is supported at one end by a shaft 24. The shaft may be attached to a drive system which causes the drum to reciprocally rotate between the first and second positions in a manner well known in the art. The other end of the housing includes an opening 26 which may be in communication with a vacuum source through a vacuum connector 28. A hollow tube 29 extends from the connecter 28 to vacuum opening 26. A sealing device (not shown) connects the tube 29 and the opening 26, and a step 30 is formed on the end wall of the feeder head to accommodate such a seal. With further reference to FIG. 3, the feeder head assembly 20 is bounded by rotating rollers 32 (shown in FIG. 2), which engage pinch rollers 33. The rollers 32 and 33 move the printable material 14 from the feeder head assembly 20 through the feeder 12. The generally cylindrical shape of the feeder head 22 is formed by the housing 34 and a removable cap 36. The cap 36 is preferably the component of the device that comes in primary contact with the printable material 14. In the present invention, the cap 36 can be removed from the housing 34 easily by an operator without removing any other component of the printing machine. The advantages of such a feature will be set forth more fully below.

Figure 5:
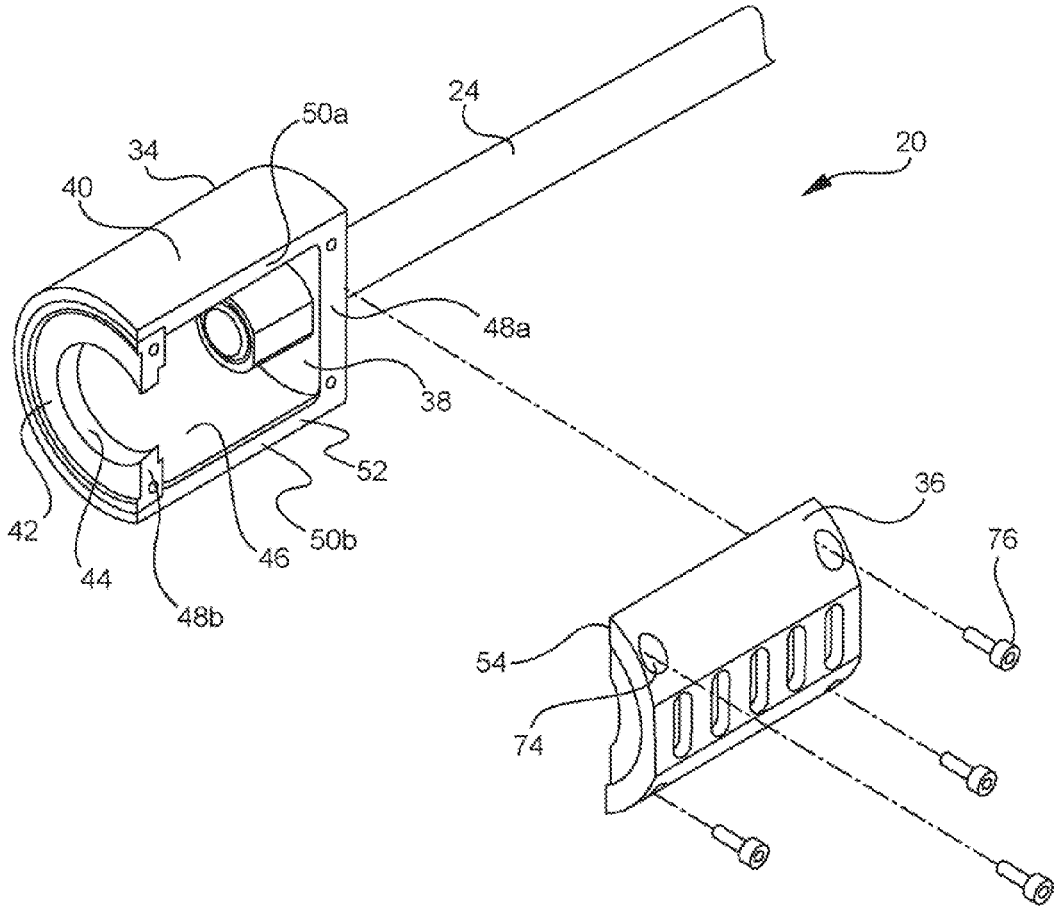
FIG. 5 is an exploded perspective view of the assembly of FIG. 4.
Figure 6:
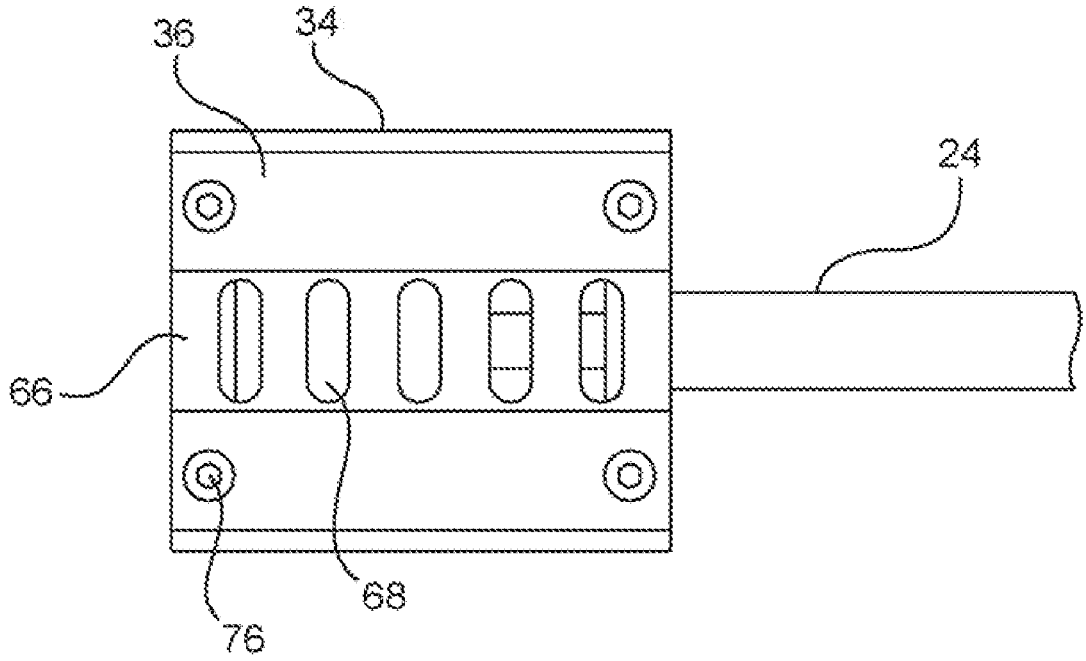
FIG. 6 is a top plan view of the assembly of FIG. 4.
Figure 8:
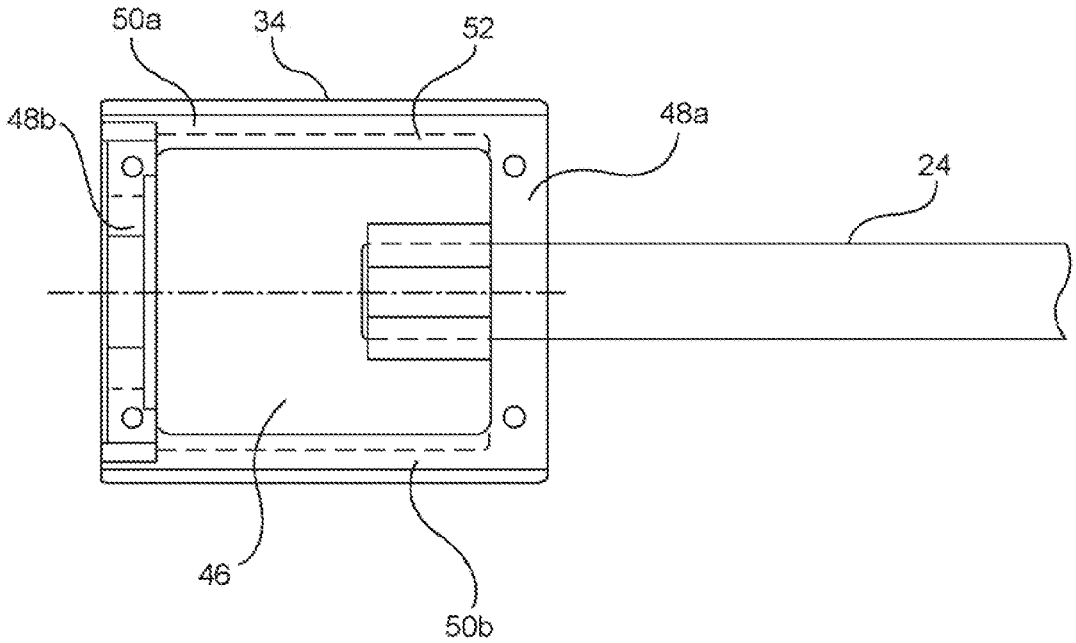
FIG. 8 is a top plan view of the assembly of FIG. 4 with the cap removed.
Figure 9A:
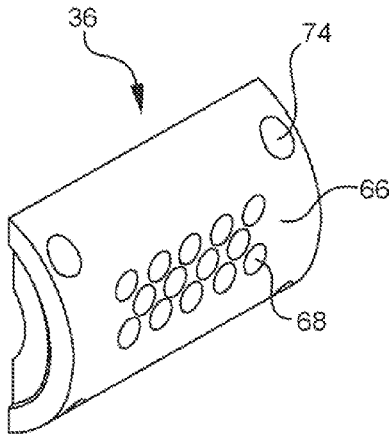
FIGS. 9A-F are perspective views of various embodiments of the cap of the present invention.
Figure 9B:
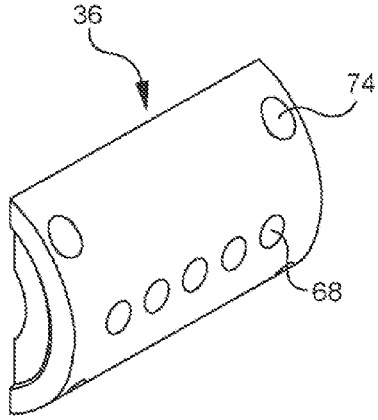
Figure 9C:
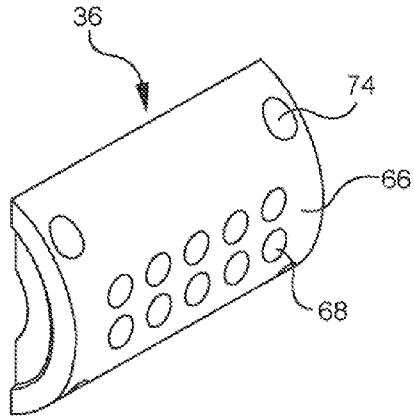
Figure 9D:
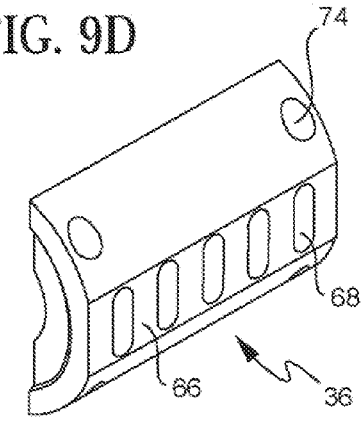
Figure 9E:
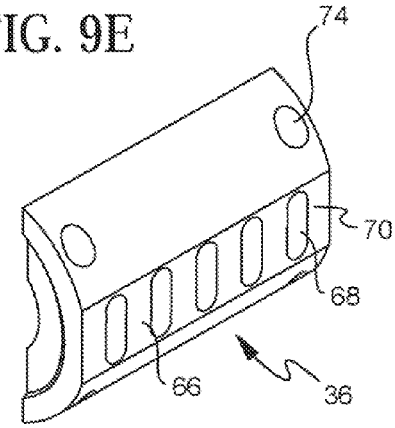
Figure 9F:
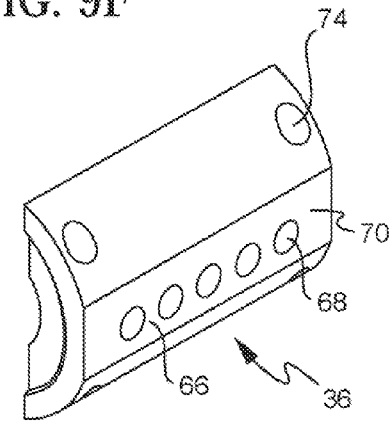

Referring to FIGS. 5 and 8, the housing 34 includes a first end wall 38 preferably having a generally D-shaped configuration. This end wall is fixedly attached to the shaft 24 which may be press-fit into an opening formed in first end wall 38. Extending outwardly from the first end wall 38 is a curved semi-tubular middle section 40 having a generally C-shaped cross-section. The middle section 40 terminates in a second wall 42 having a semi-circular aperture 44 therein. The housing 34 defines a longitudinally extending opening 46 which is covered by the cap 36. The opening 46 is preferably a single uninterrupted opening. In the preferred embodiment, the opening 46 has a generally rectangular shape. The opening 46 is defined by a first end wall edge 48*a* and a second wall edge 48*b* and by a top 50*a* and bottom 50*b* edge of the middle section 40. These edges together form a rim 52 on which sits the edges 54 bounding the perimeter of the cap 36. It should be understood, within the contemplation of the present invention, that the inner edge of the rim 52 could have a different shape from that of the outer perimeter of the rim 52. It should be also understood that the feeder head 22 and its housing 34 and cap 36 components could be made to form either more or less of the cylindrical drum, with the cap 36 designed to complete the generally cylindrical shape. The feeder head 22 is preferably formed of metal such as aluminum, although other material such as steel or plastic could be used. Also, it is understood that the housing 34 and cap 36 could be made from different materials, such as the housing 34 made of aluminum and the cap 36 made of plastic.

Figure 4:
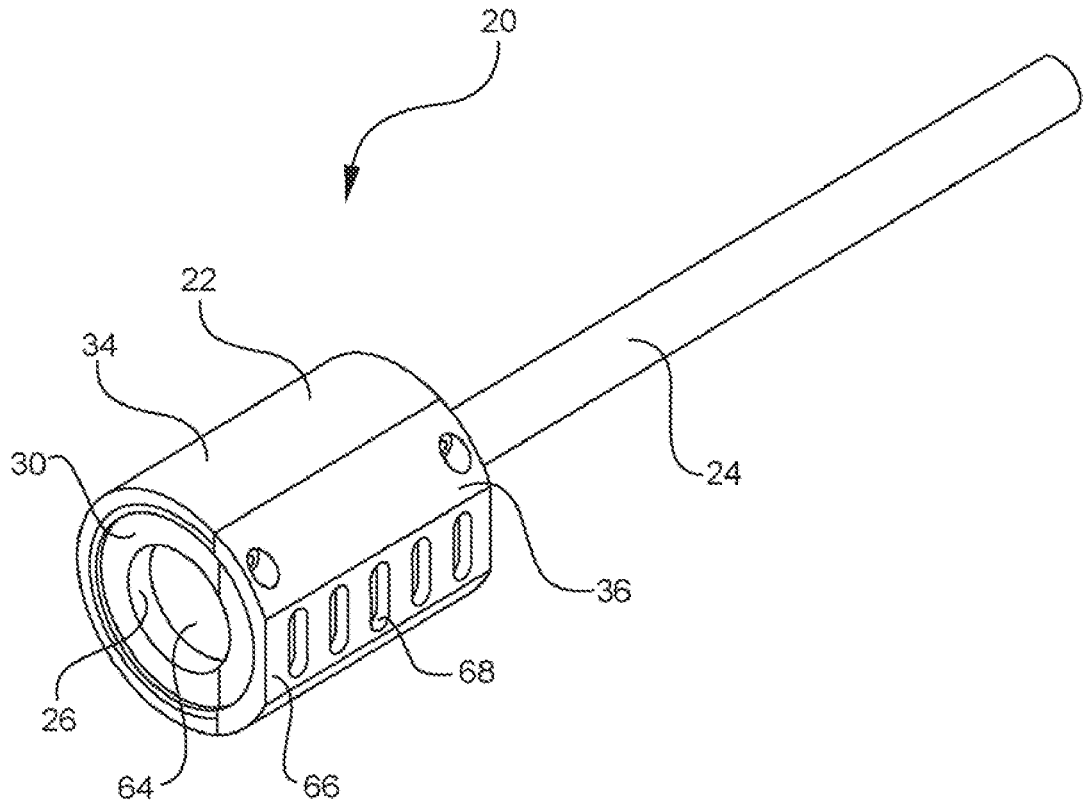
FIG. 4 is a top perspective view of portions of the assembly of the present invention.
Figure 7:
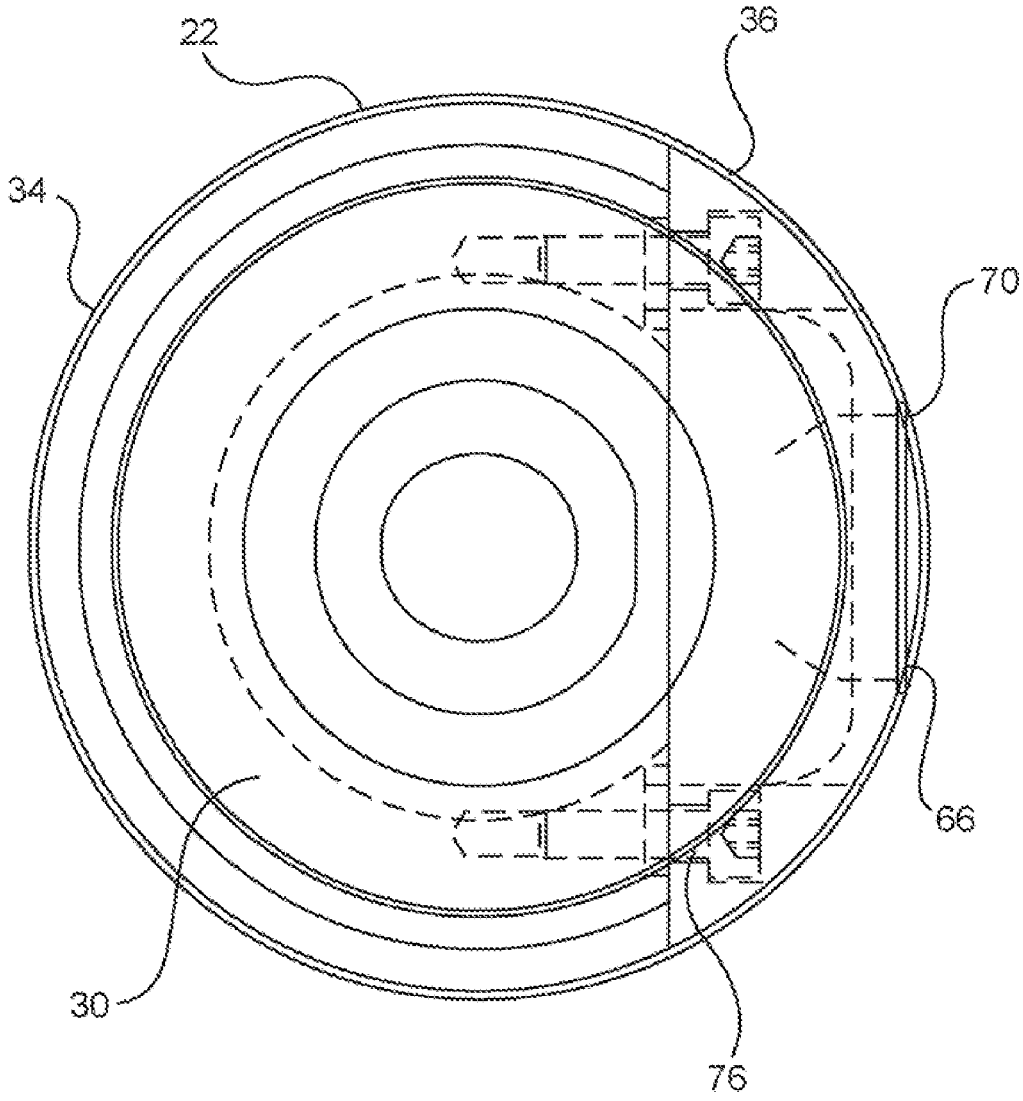
FIG. 7 is an elevational end view of the assembly of FIG. 4.
Figure 10:
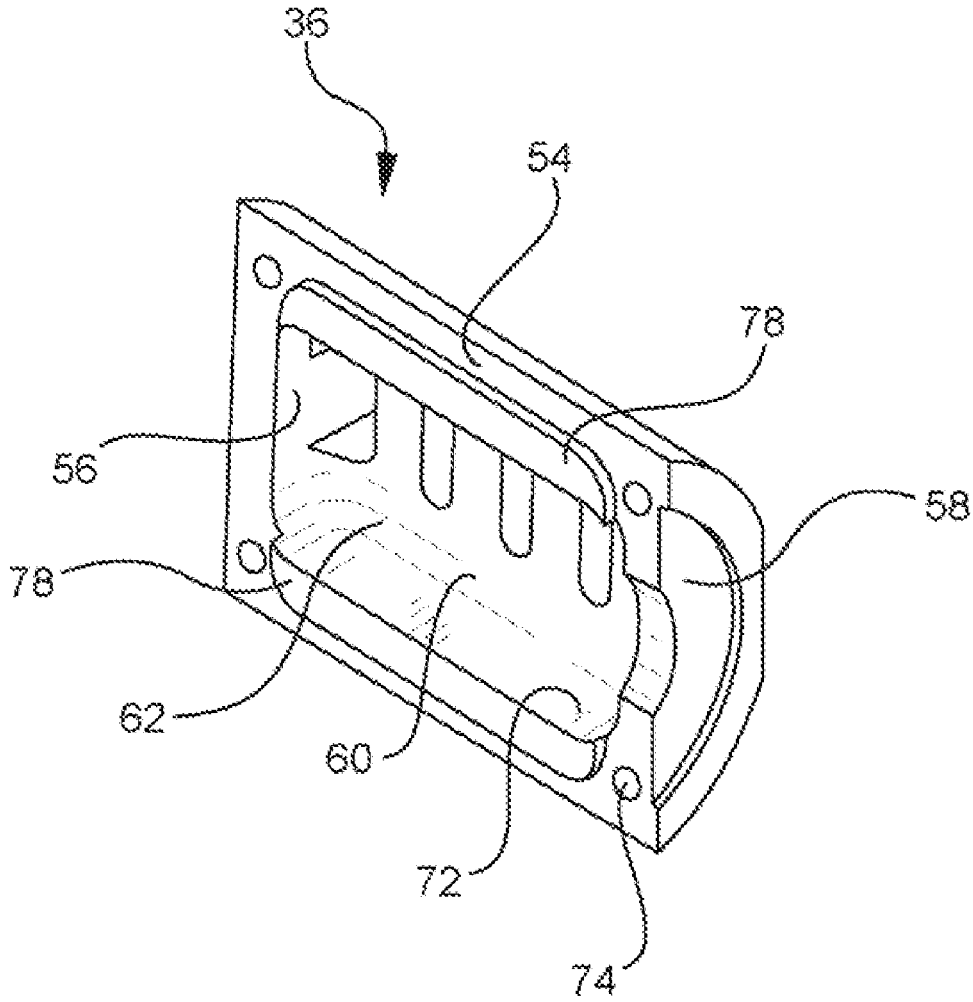
FIG. 10 is a prospective view of the bottom side of the cap of the present invention.

Referring additionally to FIGS. 9 and 10, the cap 36 is removably securable to the housing 34 over the opening 46. The cap 36 is removable from the housing 34 in the generally radial direction as shown in FIG. 5. The cap 36 preferably has a generally arcuate profile, and when it is attached to the housing 34, the feeder head 22 has a generally round cross-sectional profile. It is within the contemplation of the present invention, that the feeder head 22 could alternatively be formed in a number of different cross-sectional profile shapes, for example, square, rectangular, semi-circular, etc. Also, a sa further alternative, the feeder head 22 could have convex sides, (i.e., a barrel shape) or concave sides. As a further alternative, the housing 34 could form a portion of a generally cylindrical shape, while the cap 36 can have a different curvature or shape, or even just a portion thereof that has a different curvature or shape from the housing 34. The profile of the feeder head 22 should be designed to achieve the desired level of material engagement and handling, in conjunction with the vacuum source. The cap has first 56 and second 58 end walls connected by a central curved section 60. The first 56 and second 58 end walls and central section 60 define an inner hollow region or trough 62. When the cap 36 is secured to the housing 34, trough 62 along with the interior of the drum forms a vacuum chamber 64 (FIG. 4). The central section 60 includes a material engagement surface 66 for engaging the printable material 14. The engagement surface 66 has at least one aperture 68 to allow vacuum to be drawn there-through. In the preferred embodiment, the cap 36 includes a plurality of apertures 68 as shown in FIG. 4. In addition, it is within the contemplation of the present invention that the apertures 68 can be formed in a variety of shapes, e.g., round or slotted, and sizes, and a wide variety of aperture patterns may be used as shown in FIGS. 9A to 9F. In addition, the configuration of the material engagement surface 66 may be varied depending on the nature of the printable material 14. The engagement surface 66 may be rounded as shown in FIGS. 9A to 9D. Alternatively, the material engagement surface may have a longitudinally extending flat 70 on it as shown in FIGS. 7, 9E and 9F. Alternatively, the material engagement surface 66 may be formed in different shapes to accommodate the material that is being transferred.

The interior of the generally hollow housing 34 and the trough 62 formed in cap 36 create a relatively large vacuum chamber 64 at a location adjacent to the engagement surface 66 to which the printable material 14 is engaged. Such a volume of vacuum allows for compensation of leaks between the printable material 14 and the engagement surface 66 thereby permitting the vacuum level to remain generally constant throughout the act of transfer.

Referring specifically to FIGS. 5 and 10, the cap has a bottom side 72 that is bounded by the outer edge 54. A plurality of spaced fastening holes 74 extend through the outer edge. The outer edge 54 is configured to sit on the rim 52 of the housing. Fasteners 76, such as screws, may be used to removably secure the cap to the housing. Since the housing opening 46 extends underneath substantially the entire central section 60 of the cap, an aperture 68 formed anywhere on the central section 60 of the cap will be in communication with the vacuum chamber 64 formed within the interior of the drum 22. Therefore, caps 36 having a variety of aperture configurations and patterns may be used on the same housing 34. The configuration of the cap aperture(s) does not have to match the configuration of the drum opening.

The cap bottom side 72 may include a pair of longitudinally extending projections 78 disposed inward of the longitudinal extending edges of the cap. The projections 78 fit just within the housing opening 46 and help position the cap 36 on the housing 34.

When the feeder head assembly 20 of the present invention is disposed within a feeder 12, the cap 36 is accessible to an operator without removing other parts of the printing machine 10. Therefore, the cap 36 can be unfastened from the housing 34 and easily replaced with another cap. The ability to change the cap permits for ease of configuring the machine to correspond to the material being printed and also permits for ease of routing maintenance.

In operation, printable material 14 is placed in a feeder 12 on top of the feeder head assembly 20 and more particularly the cap 36. Vacuum is applied to the vacuum chamber 64 in the interior of the drum and to the apertures 68 in the cap 36. A piece of printable material, such as an envelope, is sucked onto the cap by action of the vacuum (FIG. 3). The shaft 24 and the feeder head 22 attached thereto are then rotated such that the envelope 14 is fed to pinch rollers 33 and carried by belts or chains to the printing station 16 in a manner well known in the art. The feeder head 22 is then rotated back to the initial position to engage another envelope 14. The feeder head 22 may be reciprocated back and forth and a high rate of speed such that 40,000 to 80,000 envelopes an hour can be fed to the printing station 16.

The cap 36 is in contact with the printable material, and this contact occurs at a very high speed. When the envelope 14 is transferred from the bottom of the stack to the pinch rollers 33, the pinch rollers, in cooperation with rollers 32, pull the envelope off the cap 36 while the envelope 14 is being held thereon by vacuum. Due to this type of action, caps 36 wear out over time, and it is a significant advantage to be able to quickly change them. In addition, depending on the nature of the printable material, different configurations and/or materials may be required. For example, if the printable material 14 to be fed is an envelope having a window, the window will come in contact with the cap 36. If the cap engagement surface 66 is too rough, then the window may be scratched, thereby reducing the quality of the finished product. It has been found that using a cap 36 made of plastic reduces the incidence of scratching. However, the surface of the cap is subject to significant wear; therefore, it is preferable that the material be wear-resistant. As set forth in U.S. Pat. No. 5,417,158 a plastic made from ultrahigh molecular weight polyethylene (UHMWPE) provides a smooth, wear-resistant surface. Alternatively, if the envelope has no window and scratching of the surface is not an issue, then an aluminum cap can be used. It has been found that an aluminum surface coated with thermal spray-plasma molybdenum, or moly coat, provides a surface that is good for gripping paper material and is highly resistant to wear. It is within the contemplation of the present invention that to form cap 36 other materials or coating may be used depending upon the desired application.

In the present invention, the cap 36 may be removed when the feeder head is secured within the feeder of the printing press without the need to remove the entire transfer device from the machine. When the feeder head assembly is in the first position, the cap and the fasteners holding the cap to the drum are readily accessible to an operator as shown in FIG. 2. The operator needs simply to remove the fastening hardware 76, lift the cap 36 off of the housing 34 in a generally radial direction, and put on and secure the replacement cap. Since the opening 46 in the housing 34 preferably extends under substantially the entire central section of the cap 60, a cap having various aperture configurations can be used without removing the housing and the shaft attached thereto.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An assembly for transporting a material in a printing apparatus comprising:

a printing unit;

a shaft at least partially rotatable about a longitudinal axis;

a feeder head supported by said shaft for conveying said material toward said printing unit, said feeder head including a housing and a cap, said housing and said cap defining a hollow chamber, said housing including an opening extending into said chamber, at least a portion of said opening extending longitudinally across a portion of said housing, said cap removeably secured to said housing, said cap having substantially the same size as said opening, said cap including at least one aperture passing therethrough wherein said at least one aperture is disposed over said opening; and a vacuum source for decreasing pressure within said hollow chamber, said vacuum source in fluid communication with said chamber and said at least one aperture.

2. The assembly of claim 1, wherein both said housing and said cap are directly engaged with an adjacent portion of said vacuum source.

3. The assembly of claim 1, wherein said cap is removable from said housing without removing said housing from said shaft.

4. The assembly of claim 1, wherein said cap is removable from said housing while said housing remains secured within said printing apparatus.

5. The assembly of claim 1, wherein said cap is removeable from said housing in a radial direction from said longitudinal axis.

6. The assembly of claim 1, wherein an inner surface of said cap defines at least a portion of said hollow chamber.

7. An assembly for transporting a material in a printing apparatus comprising:

a printing unit;

a shaft at least partially rotatable about a longitudinal axis;

a feeder head supported by said shaft for conveying said material toward said printing unit, said feeder head including a housing and a cap, said housing and said cap defining a hollow chamber, said housing including an opening extending into said chamber, at least a portion of said opening extending longitudinally across a portion of said housing, said cap removeably secured to said housing, said cap having substantially the same size as said opening, said cap including at least one aperture passing therethrough wherein said at least one aperture is disposed over said opening, wherein said cap includes an inner hollow region forming a portion of said inner hollow chamber; and a vacuum source for decreasing pressure within said hollow chamber, said vacuum source in fluid communication with said chamber and said at least one aperture.

8. The assembly of claim 1, further comprising:

a drive mechanism coupled to said shaft, wherein said drive mechanism is adapted to move said feeder head between a first position and a second position.

9. A feeder head assembly for transporting a material in a printing apparatus, said feeder head assembly comprising:

a housing at least partially rotatable about a longitudinal axis, said housing including an inner hollow chamber and an outer opening into said chamber, said inner hollow chamber adapted to be in fluid communication with a vacuum source for decreasing pressure within said chamber, said opening extending longitudinally across a substantial portion of said feeder head; and a cap removeably secured to said housing, said cap covering at least a portion of said opening, said cap including at least one aperture passing therethrough, wherein said at least one aperture is in fluid communication with said vacuum source.

10. The assembly of claim 9, wherein said hollow chamber includes portions disposed on opposed sides of said longitudinal axis.

11. The assembly of claim 9, wherein said at least one aperture includes a plurality of apertures aligned in at least one row.

12. The assembly of claim 9, wherein said cap includes at least one projection extending from said cap inwardly beyond said rim toward said chamber.

13. The assembly of claim 9, wherein said housing includes a pair of opposed end walls, said end walls defining said longitudinal extent of said opening, and said cap extends between said end walls.

14. The assembly of claim 9, wherein at least a portion of said cap defines at least a portion of an axial end of said feeder head assembly.

15. A feeder head assembly for transporting a material in a printing apparatus, said feeder head assembly comprising:

a housing at least partially rotatable about a longitudinal axis, said housing including an inner hollow chamber and an opening into said chamber, said inner hollow chamber adapted to be in fluid communication with a vacuum source for decreasing pressure within said chamber; and a cap removeably secured to said housing, said cap covering at least a portion of said opening, said cap including at least one aperture passing therethrough, wherein said at least one aperture is in fluid communication with said vacuum source, wherein an inner surface of said cap defines at least a portion of said inner hollow chamber.

16. A feeder head assembly for transporting a material in a printing apparatus, said feeder head assembly comprising:

a housing at least partially rotatable about a longitudinal axis, said housing having an inner hollow chamber and an opening into said chamber, said inner hollow chamber adapted to be in fluid communication with a vacuum source for decreasing pressure within said chamber, said opening defined by a rim; and a cap removeably secured to at least a portion of said rim, said cap including at least one aperture passing therethrough, wherein said at least one aperture is in fluid communication with said vacuum source, wherein said opening has a different configuration from that of said at least one aperture.

17. The assembly of claim 16, wherein at least a portion of said rim extends longitudinally across a portion of said housing.

18. The assembly of claim 16, wherein said hollow chamber includes portions disposed on opposed sides of said longitudinal axis.

19. The assembly of claim 16, wherein said at least one aperture includes a plurality of apertures aligned in at least one row.

20. The assembly of claim 16, wherein an inner surface of said cap defines at least a portion of said inner hollow chamber.

21. The assembly of claim 16, wherein said cap has a perimeter and at least a portion thereof is disposed on at least a portion of said rim.

22. The assembly of claim 16, wherein said cap includes a trough which forms an extension of said inner hollow chamber.

23. The assembly of claim 16, wherein said cap is removeable from said feeder head in a radial direction from said longitudinal axis.

24. The assembly of claim 16, wherein at least a portion of said cap defines at least a portion of an axial end of said feeder head assembly.

25. The assembly of claim 16, wherein said cap includes at least one projection extending from said cap into said opening toward said chamber.

26. The assembly of claim 16, further comprising:

a shaft supporting said housing and adapted to rotate said housing between a first and second position.

* * * * *